US005115752A

United States Patent [19]

Mitchell

[11] Patent Number: 5,115,752

[45] Date of Patent: May 26, 1992

[54] ROD KICKER FOR A SAILING VESSEL RIG

[75] Inventor: Andrew Mitchell, Brading, United Kingdom

[73] Assignee: Offshore Instruments Limited, Cowes, United Kingdom

[21] Appl. No.: 609,805

[22] Filed: Nov. 6, 1990

[30] Foreign Application Priority Data

Nov. 2, 1989 [GB] United Kingdom ..... 8924767
Oct. 30, 1990 [FR] France ..... 90 13466

[51] Int. Cl.[5] ..... B63B 35/00

[52] U.S. Cl. ..... 114/39.1; 114/99; 114/89

[58] Field of Search ..... 114/39.1, 89, 90, 97-99, 114/102, 103, 221 R; 52/121

[56] References Cited

U.S. PATENT DOCUMENTS 4,367,688 1/1983 Godfrey ..... 114/39.1
4,406,240 9/1983 Anderson ..... 114/102 X
4,539,927 9/1985 Foresman ..... 114/89

FOREIGN PATENT DOCUMENTS 8809743 12/1988 PCT Int'l Appl. ..... 114/97

*Primary Examiner*—Edwin L. Swinehart
*Attorney, Agent, or Firm*—Ware, Fressola, Van Der Sluys & Adolphson

[57] ABSTRACT

A Rod Kicker: is disclosed for applying downhaul to a boom of a sailing rig. The rod kicker consists of two telescopically engaged elongate struts (4, 5). One end of one strut is secured to a mast (2) below the boom (3) and the remote end of the other strut (5) to the underside of the boom (3). A pulley system acts between the struts to enable the strut (5) to be retracted into the strut (4). A pawl and rack assembly locks the struts together to prevent the boom dropping when no lift is applied by the sail. Operation of the pulley system unlocks the pawl and rack to allow retraction.

13 Claims, 3 Drawing Sheets

ROD KICKER FOR A SAILING VESSEL RIG

BACKGROUND OF THE INVENTION

1. Field of the Invention

The present invention concerns the provision of a rod kicker for the control of a sailing vessel rig.

2. Description of the Related Art

In a conventional sailing vessel rig the sail is deployed on a mast and boom. When under sail, the sail of such a rig tends to lift the boom, in consequence it is necessary to provide a kicker device to act between the boom and the mast in order to draw the boom downwards and maintain sail trim. In its most primitive form the kicker consists of a simple rope and pulley assembly. However, in sailing yachts it is desirable to be able to support the boom in a horizontal or raised condition when not under sail in order not to present an obstruction and hazard to the crew. It has therefore become recent practise to employ a rod kicker which consists of a telescopic strut with some form of drive assembly to provide purchase between relatively extensible members of the strut whereby the rod kicker can be retracted under sail, but which has a limited degree of retractability in order to support the boom when not under sail.

The weakness of most existing designs of rod kicker comes from the problem that, it must be possible to set the boom at a height sufficiently low to provide for correct sail trim, but this is commonly a height lower than is convenient when not under sail. To solve this problem it is conventional to incorporate a spring member within the rod kicker which biases the rod kicker to an extended condition and hence lifts the boom. However, this means that the spring force must be overcome in order to trim the sail.

SUMMARY OF THE INVENTION

It is an object of the present invention to provide a rod kicker of simple construction which reliably supports the boom at a convenient height and alleviates the aforementioned disadvantage of the prior art rod kicker described above.

According to the present invention there is provided a rod kicker comprising; a first elongate member being provided at one end with mounting means to engage a mast, a second member extensibly and retractably engaged with the first member such that an end of the second member projects from the other end of the first member, the projecting end of the second member having means to engage a boom, a drive assembly operable between said first and second members to retract the second member, and a brake mechanism acting between the first and second members to prevent retraction of the second member unless the drive assembly is operated to retract the second member.

Preferably the first and second members are tubular and telescopically engaged one with the other. The drive assembly may conveniently be provided by a pulley system which is advantageously installed within one of the members.

In a preferred form of the rod kicker the brake mechanism is provided by a ratchet and pawl device conveniently installed within one of the members. In this rod kicker the pawl is engaged with the drive assembly so that when the drive assembly is relaxed the pawl is biased to engage in the ratchet which prevents contraction of the kicker rod. Upon initial operation of the drive assembly the pawl bias is overcome to disengage the pawl from the ratchet allowing the rod kicker to be contracted. It will be realised that the pawl biasing force is conveniently relatively weak in comparison with the spring biasing force required by conventional rod kickers which makes the rod kicker of the present invention much easier to operate.

Although the use of a ratchet and pawl braking device is preferred for most applications the use of other types of braking mechanism, such as a friction clutch, are contemplated.

BRIEF DESCRIPTION OF THE DRAWINGS

An embodiment of a rod kicker constructed in accordance with the present invention, will now be described by way of example only, with reference to the accompanying drawings; in which, FIG. 1, schematically illustrates the rod kicker mounted on a sailing rig.

DESCRIPTION OF THE PREFERRED EMBODIMENT(S)

Figure 1:
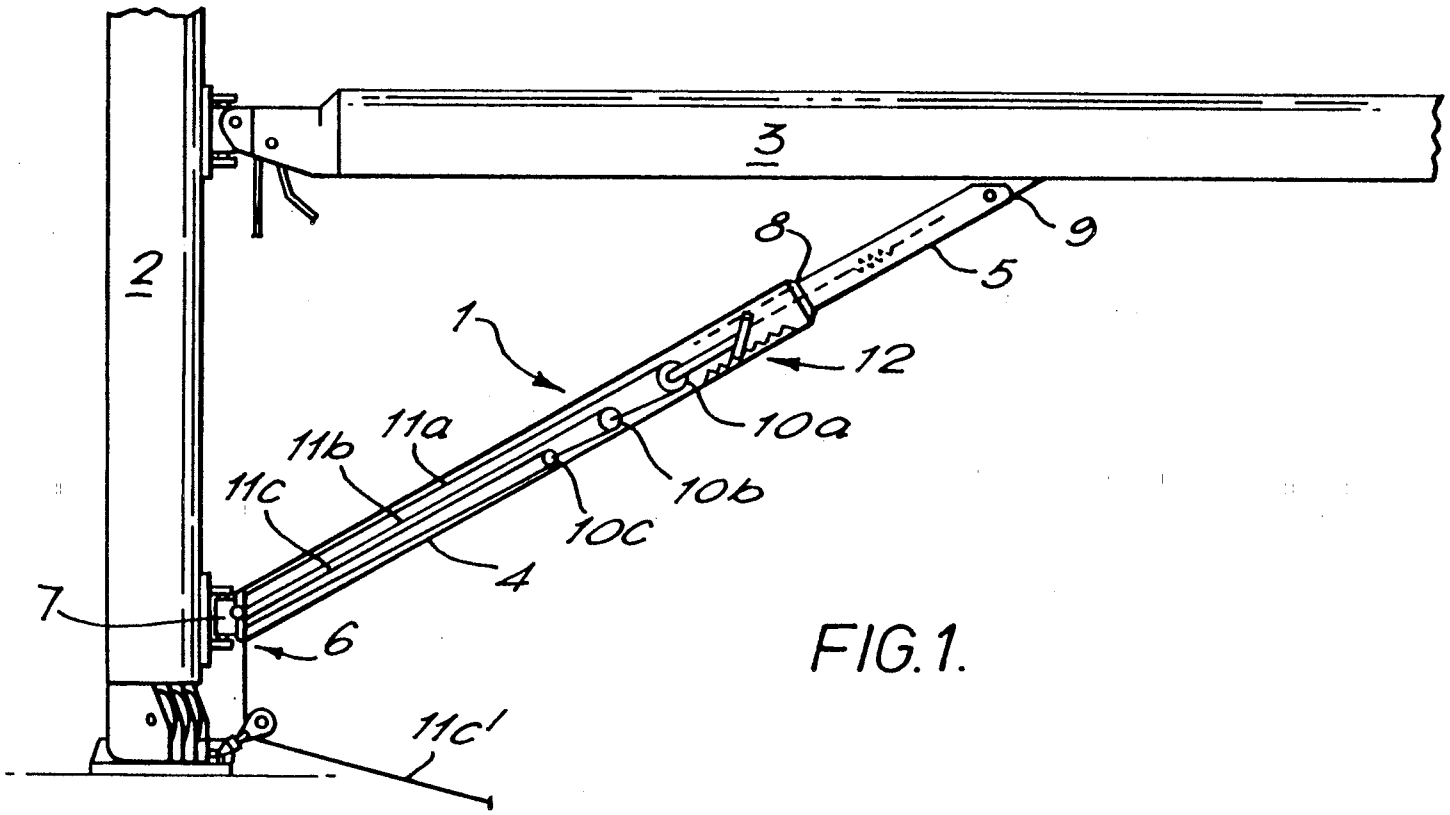
Figure 3:
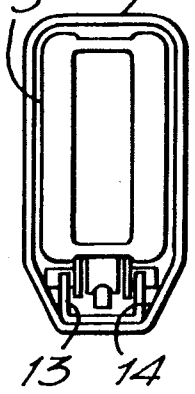
FIG. 3 is a view on III—III in FIG. 2.

Referring to the drawings, FIG. 1 shows a rod kicker 1 installed in a sailing rig comprising a mast 2 and a boom 3. The rod kicker consists of two, tubular, box section members herein known as a lower rod 4 and an upper rod 5. The lower rod 4 has an end 6 provided with a pivotal mast mounting unit 7 by means of which the end 6 is secured to the foot of the mast 2, below the boom 3. The upper rod 5 is slidably received into the other end 8 of the lower rod 4 and an end of the upper rod 5 projecting from the lower rod 4 is provided with a pivotal boom mounting unit 9 whereby the rod kicker 1 is secured to the boom.

A drive assembly consists of a cascaded array of pulleys 10 which is secured by means of a brake mechanism to the upper rod 5. An array of ropes 11 is passed around the pulley array 10, such that a separate rope passes around each pulley, each rope having one end secured to the end 6 of the lower rod 4 and the other end being arranged to support a next one of the pulleys. The last rope 11*c* in the array has a free end 11*c'* which extends from the end 6 of the lower rod 4. Tension applied to the free end 11*c'* will cause the upper rod 5 to be retracted into the lower rod 4 thereby pulling the boom, downwards. The pulley array 10 provides a mechanical advantage, which in this case is eight to one.

Figure 2:
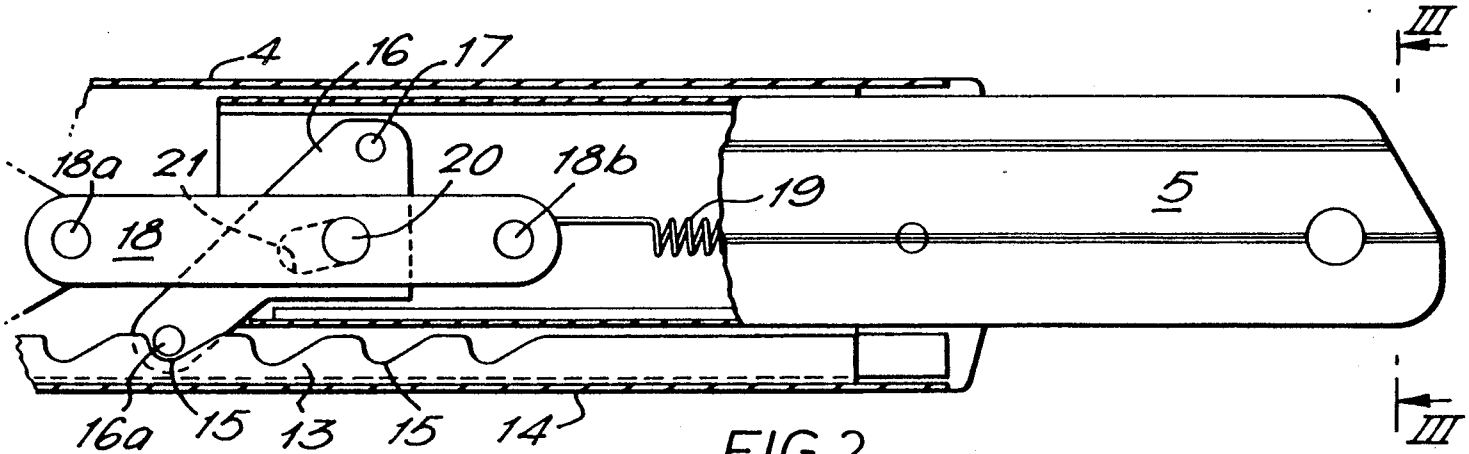
FIG. 2, is an enlarged view of part of the rod kicker in FIG. 1 partially sectioned to show details of a brake mechanism operable between first and second members of the rod kicker.
Figure 4:
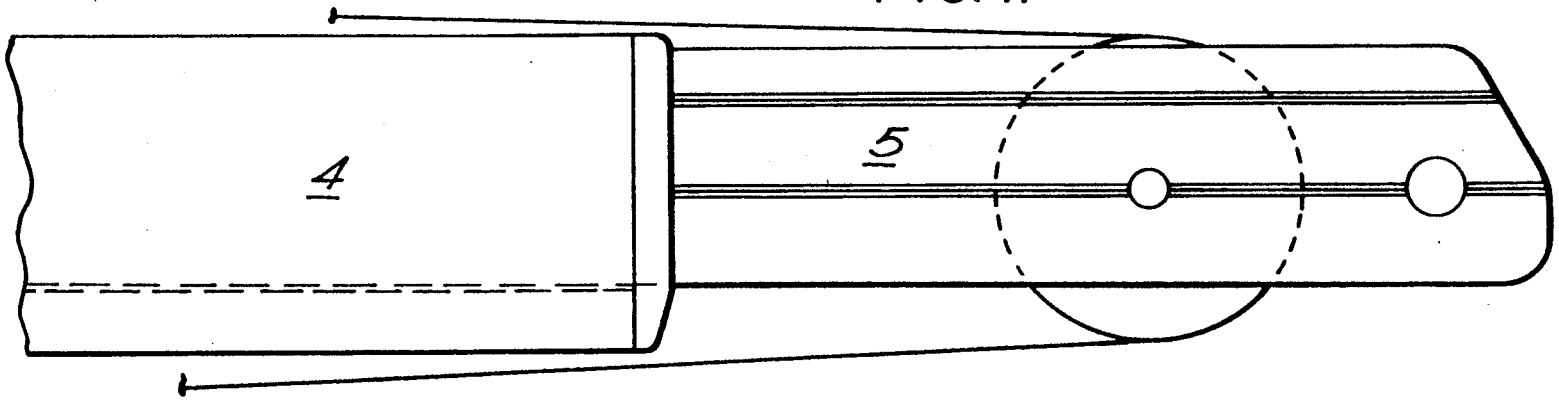
FIG. 4 is a external view of FIG. 2.

As was mentioned above, the pulley array is secured to the upper rod 5 by way of the brake mechanism 12. This is most clearly shown in FIG. 2.

The brake mechanism 12 consists of a toothed ratchet bar 13 mounted in a longitudinally extending channel 14 in the lower most side of the lower rod 4, and a pawl sub-assembly secured to the upper rod 5. The ratchet bar 13 provides a plurality of recesses 15 distributed in the longitudinal direction. The pawl sub-assembly comprises a pawl 16 pivotally mounted by a pivot pin 17 so that an end 16*a* can be rotated into and out of engagement with one of the recesses 15. The attitude of the pawl 16 when engaged in one of the recesses 15 is arranged so that the pawl 16 tends to be driven into engagement with the recess 15 when the rod kicker is urged to contract by a force not applied by the drive assembly; but disengages from the recess 15 when the rod kicker is urged to extend. In order to allow contraction of the rod kicker when a force is applied by way of the drive assembly, the brake mechanism includes an elongate link 18. The link 18 is aligned in the longitudinal direction and is secured at one end 18*a* to the drive assembly and at the other end 18*b* to a tension spring 19 which is affixed by means of a pin to the upper rod 5. The link 18 overlies the pawl 16 and is provided with a cam-pin 20 which extends laterally from the link 18 to engage in a cam-slot 21 provided in the pawl 16.

Thus, when no force is applied by the drive assembly, the tension spring 19 displaces the link 18 in the direction of the boom mounting unit 9, the action of the cam-pin 20 engaging in the cam-slot 21 then rotates the pawl 16 to engage in one of the recesses 15 in the ratchet bar 13 and hence prevents contraction of the rod kicker. However, the rod kicker can be extended, for example, by lifting the boom 3, which will then conveniently remain in the raised condition. However if tension is applied to the drive assembly the spring tension is readily overcome to displace the link 18 in the direction of the end 6. The action of the cam-pin 20 engaging in the cam-slot 21 then causes the pawl 16 to rotate out of engagement with the ratchet bar 13 and hence allow the rod kicker to be contracted.

In a preferred embodiment of the invention means to normally disable the action of the braking assembly may be provided. This means may take the form of a latch to secure the link 18 in a position displaced towards the end 6. Such a feature can prove advantageous in a situation, such as yacht racing, where very rapid adjustment of the downhaul tension is sometimes desired.

Figure 5:
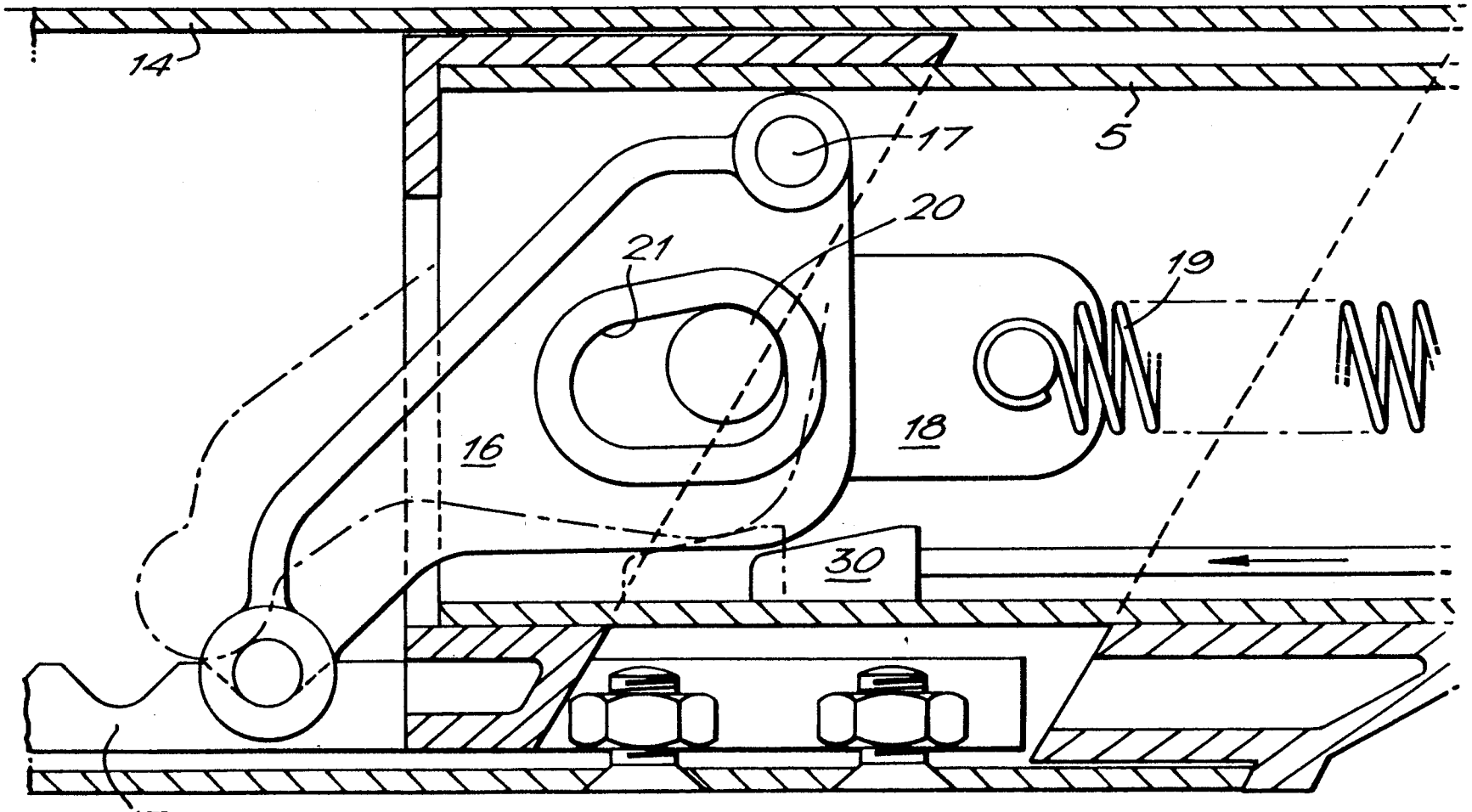
FIG. 5 is a sectional view of a second embodiment of the invention.

An alternative embodiment of the rod kicker is shown in FIG. 5. In this construction, a wedge 30 is supported to be slidably displaced along a track formed in the rod 5 when a connecting rod is longitudinally displaced by manual operation of a mechanism such as a lever (not shown). When the wedge 30 is displaced to engage the pawl 16, the pawl 16 is prevented from engaging the rack 13.

I claim:

1. A rod kicker comprising:

a first elongate member having a fixture end and another end;

a second elongate member also having a fixture end and another end, the second elongate member being extensibly and retractibly engaged with the first elongate member such that the fixture end of the second elongate member projects from the other end of the first elongate member;

a mast mounting provided at one of the fixture ends;

a pull-down pulley system operable between the first and second elongate members to retract the second elongate member;

the pull-down pulley system having two ends, one end being connected to the other end of the second elongate member and the other end being connected to the fixture end of the first elongate member, and the pull-down pulley system including:

one pulley connected to one of the first and second elongate members at the one or the other of the ends of the system and one rope, the rope being fast at one of its ends with the other of the first and second elongate members at the other end of the system, the rope passing over said one pulley and passing out of the rod kicker whereby the other end of the rope is free for actuation of the rod kicker;

a one-way brake mechanism including a first element fixed to the first elongate member and a second element connected both to the second elongate member for engagement with the first element to lock the second elongate member against retraction with respect to the first elongate member and to the pull-down pulley system for withdrawal of the second element from the first element when the pull-down pulley system is actuated to retract the second elongate member with respect to the first elongate member, the one-way brake mechanism allowing disengagement of the second element when the pull-down pulley system is free for extension of the second elongate member with respect to the first elongate member.

2. A rod kicker according to claim 1, wherein the one-way brake mechanism is contained within the first and second elongate members.

3. A rod kicker according to claim 1, wherein the first element of the one-way brake mechanism is a rack bar and the second element is a pawl biased to engage the rack bar, and the pull-down pulley system is so connected to the pawl that actuation of the pull-down pulley system to retract the second elongate member initially displaces the pawl in opposition to the bias to disable the locking action.

4. A rod kicker according to claim 3, wherein the pawl is biased by spring means.

5. A rod kicker according to claim 4, including a link connected to the pull-down pulley system and cammingly connected to the pawl and wherein the spring means is a spring connecting the link to the second elongate member.

6. A rod kicker according to claim 1, wherein the pull-down pulley system includes a plurality of pulleys arranged in a cascade and a plurality of ropes, a first of the pulleys is attached to the one of the first and second elongate members at said one end of the pull-down pulley system, a first of the ropes is fast at one of its ends with the other of the first and second elongate members, passes over the first of the pulleys and carries a next one of the pulleys at its free end, a last of the pulleys is said one pulley connected to the one of the first and second elongate members at said one end of the system, its connection being via previous one of the pulleys and the ropes and a last of the ropes is the said one rope fast at one of its ends with the other of the first and second elongate members, passes over the last of the pulleys and out of the rod kicker.

7. A rod kicker according to claim 1, wherein the one pulley connected to the one of the first and second elongate members at one end of the system is connected to the second elongate member.

8. A rod kicker according to claim 1, wherein the one rope passing out of the rod kicker passes out at the fixture end of the first elongate member.

9. A rod kicker according to claim 1, wherein said mast mounting is provided at the fixture end of the first elongate member and boom engaging means is provided at the fixture end of the second elongate member.

10. A rod kicker according to claim 1, wherein means is provided to engage the second element and hold it clear of the first element to disable the locking action of the one-way brake mechanism.

11. A rod kicker according to claim 10, wherein the means to engage the second element is a wedge slidingly arranged on the second elongate member.

12. A rod kicker comprising a first elongate member adapted at one end to be provided with a mast mounting, a second elongate member extensibly and retractibly engaged with the first member such that an end of the second member projects from the other end of the first member, the projecting end of the second member being adapted to be provided with means to engage a boom, a drive assembly operable between said first and second members to retract the second member, a brake mechanism having a locking action between the first and second members to prevent retraction of the second member unless the drive assembly is operated to retract the second member the brake mechanism comprising a pawl mounted on one of the members and biased to engage a rack bar mounted on the other of the members, the drive assembly being arranged such that operation to retract the second member initially displaces the pawl in opposition to the bias to disable the locking action.

13. A rod kicker according to claim 12, wherein the pawl is biased by spring means.

* * * * *